US005464005A

United States Patent [19]

Mizrahi

[11] Patent Number: 5,464,005

[45] Date of Patent: Nov. 7, 1995

[54] STOVE

[76] Inventor: Zadok Mizrahi, 52 Samech Heh Street, Kfar Shalem, Israel

[21] Appl. No.: 55,704

[22] Filed: Apr. 30, 1993

[51] Int. Cl.[6] ..... F24C 3/00

[52] U.S. Cl. ..... 126/39 R; 126/21; 126/42; 126/37 B

[58] Field of Search ..... 126/39 R, 41 R, 126/24, 37 B, 42, 39 BA, 275 E, 273 A

[56] References Cited

U.S. PATENT DOCUMENTS

| | | | |
|---|---|---|---|
| 2,109,006 | 2/1938 | Davis | 126/37 B |
| 3,023,747 | 3/1962 | Chambers | 126/37 B |
| 3,200,808 | 8/1965 | Swift | 126/37 B |
| 5,263,467 | 11/1993 | Jones | 126/37 B X |

FOREIGN PATENT DOCUMENTS

| | | |
|---|---|---|
| 185637 | 3/1936 | Switzerland . |
| 530775 | 3/1972 | Switzerland . |
| 2112127 | 10/1982 | United Kingdom . |

*Primary Examiner*—Larry Jones
*Attorney, Agent, or Firm*—Darby & Darby

[57] ABSTRACT

A stove which includes a base adapted for mounting on to a fixed object, a burner unit, a fuel supply line extending between the burner unit and a fuel source, a regulator for control of fuel supply along the supply line, and mounting apparatus for pivotably mounting the burner unit onto the base.

10 Claims, 8 Drawing Sheets

STOVE

FIELD OF THE INVENTION

The present invention relates to shoves, especially cooking stoves.

BACKGROUND OF THE INVENTION

Domestic kitchen stoves, as well as other stoves, are typically intended for cooking, frying, boiling and the like, by heating food contained in vessels. Installment of a stove usually requires significant space, often at the expense of an already existing table, counter or cupboard, and sometimes a specially designated surface has to be set up. In addition, use of a stove generates hard to clean dirt from oily sediment which is difficult to reach because of the many elements which comprise the stove. Moreover, safety is a prerequisite condition for any stove, since gas leakage, liquid gas spillage, or electric shock are dangerous to the operator.

U.K. Patent No. 2,112,127 relates to stove units that are detachable from a base unit.

SUMMARY OF THE INVENTION

An object of the present invention is to provide a cooking stove which occupies little space, especially when not in operation, is easy to clean and operate and conforms to safety requirements.

There is provided, therefore, in accordance with an embodiment of the invention, a stove which includes a base adapted for mounting on to a fixed object, a burner unit, a fuel supply line extending between the burner unit and a fuel source, a regulator for control of fuel supply along the supply line, and mounting apparatus for pivotably mounting the burner unit onto the base.

Additionally in accordance with an embodiment of the invention, there is also provided motor apparatus for moving the burner unit about the base between the operative orientation and the storage position.

Further in accordance with an embodiment of the invention, the mounting apparatus is adapted to permit pivoting of the burner unit between an operative orientation, whereat cooking on the burner unit is permitted, and a storage position.

Additionally in accordance with an embodiment of the invention, the regulator is an automatic fuel supply regulator and is operative to permit fuel supply along the supply line when the burner unit is in the operative orientation, and is further operative to prevent fuel supply along the supply line when the burner unit is not in the operative orientation.

In accordance with one embodiment of the invention, there are provided a plurality of burner units, of which at least one of which at least one is a fluid fuel burner unit and at least one is an electric burner unit.

Additionally in accordance with an embodiment of the invention, the electric burner unit includes mounting apparatus for pivotably mounting the electric burner unit onto the base, wherein the mounting apparatus is adapted to permit pivoting of the burner unit between an operative orientation, whereat cooking on the burner unit is permitted, and a storage position.

Further in accordance with an embodiment of the invention, there is also provided electrical supply apparatus for permitting operation of the electric burner when in the operative orientation, and for preventing operation thereof when the electric burner unit is not in the operative orientation.

In accordance with a further embodiment of the invention, there is also provided a combined fluid fuel burner and electric burner unit.

Additionally in accordance with an embodiment of the invention, the combined fluid fuel and electric burner unit includes mounting apparatus for pivotably mounting the fluid fuel and electric burner unit onto the base, wherein the mounting apparatus is adapted to permit pivoting of the burner unit between an operative orientation, whereat cooking on the burner unit is permitted, and a storage position.

Further in accordance with an embodiment of the invention, there is also provided electrical regulation apparatus for permitting electrical operation of the fluid fuel and electric burner when in the operative orientation, and for preventing operation thereof when the fluid fuel and electric burner unit is not in the operative orientation.

There is also provided, in accordance with an alternative embodiment of the invention, a stove which includes a base adapted for mounting on to a fixed object, one or more electric burner units, and apparatus for pivotably mounting the one or more electric burner units onto the base, wherein the mounting apparatus is adapted to permit pivoting of the burner units between an operative orientation, whereat cooking on the burner unit is permitted, and a storage position.

In accordance with yet a further embodiment of the invention, there is provided a stove which includes a base adapted for mounting on to a fixed object, a combined fluid fuel and electric burner unit, a fuel supply line extending between the burner unit and a fuel source, a regulator for control of fuel supply along the supply line, and apparatus for pivotably mounting the combined burner unit onto the base, wherein the mounting apparatus is adapted to permit pivoting of the burner unit between an operative orientation, whereat cooking on the burner unit is permitted, and a storage position.

BRIEF DESCRIPTION OF THE DRAWINGS

The present invention will be more fully understood and appreciated from the following detailed description, taken in conjunction with the drawings, in which.

DETAILED DESCRIPTION OF THE INVENTION

Figure 1:
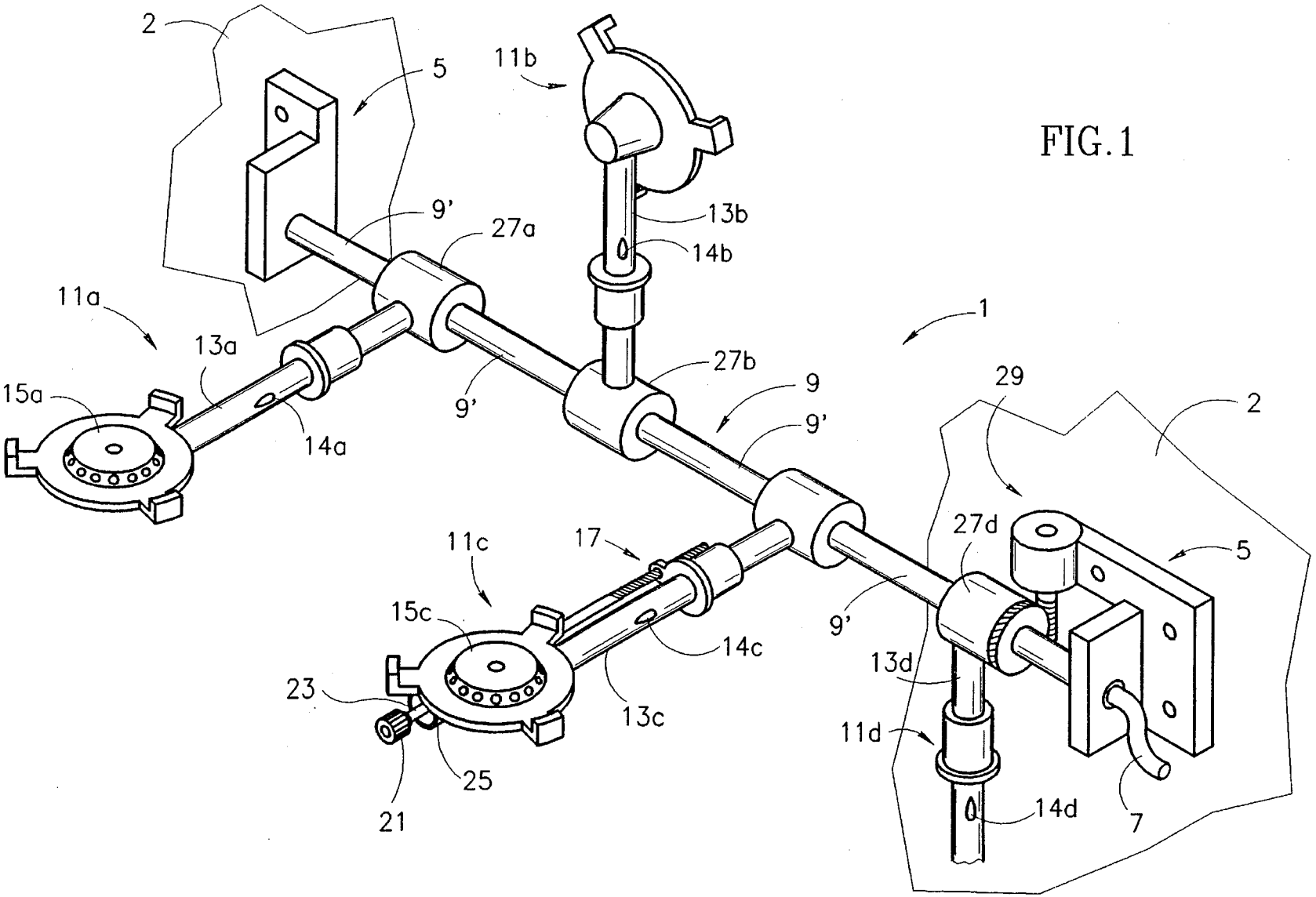
FIG. 1 is a general view of a four-burner stove constructed in accordance with an embodiment of the present invention.

Referring now to FIG. 1, there is illustrated a stove, referenced generally 1, constructed in accordance with a preferred embodiment of the present invention. Stove 1 is mountable to a wall or work surface, referenced 2, via brackets 5, and is arranged to be foldable relative to surface 2, between operational and nonoperational positions.

It should be noted that stove 1 is intended for use with any type of fluid fuel suitable for use as a cooking fuel. Accordingly, such fuel may be gas, kerosene or alcohol, for example.

According to the present embodiment, therefore, stove 1 uses a fluid fuel source (not shown) which is supplied via a fuel supply line 7 to a base member 9. Base member 9 is adapted to support a plurality of burner units, referenced 11*a*–11*d*, having respective arms, referenced 13*a*–13*d*, and burner heads, referenced 15*a*–15*d*, respectively. Base member 9 is further formed as a conduit via which fluid fuel is conducted to the burner units 11*a*–11*d*. According to the present embodiment, base 9 is preferably comprised of a plurality of interconnecting rigid pipe members, each indicated by reference numeral 9'.

The arms 13*a*–13*d* are coupled to base member 9 via joints referenced 27*a*–27*d*, respectively. These joints 27*a*–27*d* are mounted onto respective pipe members 9' so as to provide independent pivotal movement of each burner unit 11*a*–11*d* the longitudinal axis of pipe members 9'.

In FIG. 1, it is seen that two burner units, namely those referenced 11*a* and 11*c*, are deployed in generally horizontal operating positions, while burner units 11*b* and 11*d* are aligned in generally vertical positions for storage. Burner unit 11*d* is aligned downwards and burner unit 11*b* upwards for demonstrative purposes only, since, in practice, for reasons of economy of space, a uniform direction would be preferred. The arms 13*a*–13*d* are of different predetermined lengths for efficient spacing of the burner heads. Burner unit 11*a* is illustrated with an exemplary fuel flow regulator 17, and an optional drive unit 29 is illustrated, also by way of example, attached to joint 27*a*, for raising and lowering burner unit 11*d*. Fuel conducting arms 13*a*–13*d* may also comprises jet nozzles (not shown) and air inlets 14 may also be provided in the fuel conducting arms so as to provide proper volumetric flow and air mixture of the fluid fuel to the burner heads.

It will be appreciated that while not all of the above burner units 11*a*–11*d* are illustrated as having a fuel regulator 17 and a drive unit 29, this is for the sake of clarity only. In accordance with embodiments of the invention, each of the burner units 11*a*–11*d* may be equipped with either or both of regulator 17 and drive unit 29.

Figure 2:
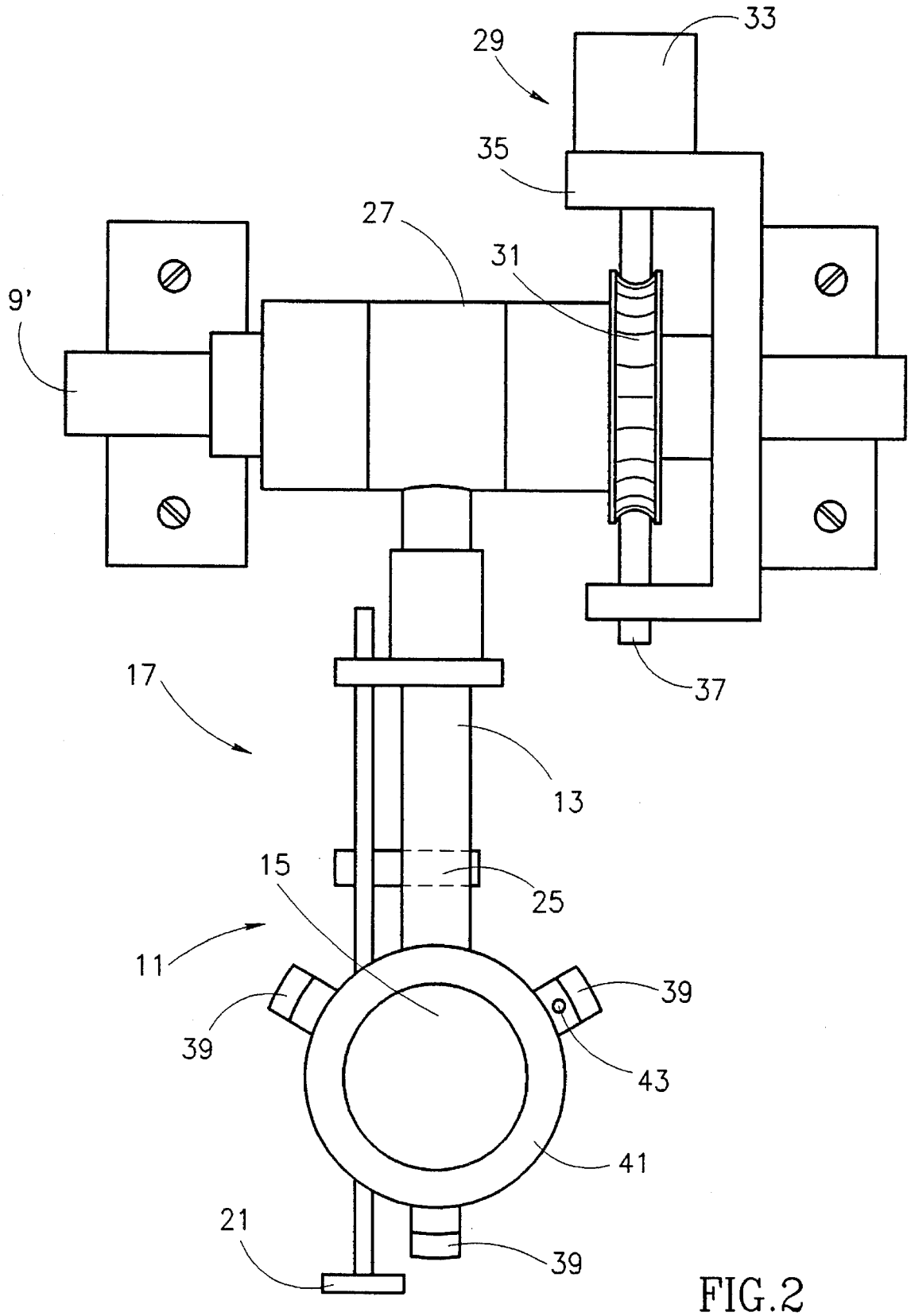
FIG. 2 is a schematic side view of one embodiment of the invention.

Reference is now made to FIG. 2 in which fluid flow regulator 17 and drive unit 29 are illustrated in greater detail. In FIG. 2, a burner unit 11 is shown in a non-operational, generally downward orientation similar to the positioning of burner unit 11*d* in FIG. 1. Fur the purpose of brevity, components illustrated in FIG. 2 that correspond to components illustrated in FIG. 1 are designated with similar reference numerals as in FIG. 1 but without a suffix.

Accordingly, burner unit 11 has a burner head 15 which is connected to pipe member 9' via an arm 13 and a joint element 27. Regulator 17 is mounted on arm 13. The burner head 15 may be configured for disassembly from arm 13 for cleaning.

According to the illustrated embodiment, drive unit 29 comprises a power unit 33, a toothed wheel 31 rigidly coupled to joint 27, and a worm 37 for driving the wheel 31 in a selected direction. Power unit may be any suitable electric, gas, hydraulic, or pneumatic motive means. The power unit 33 is rigidly mounted onto pipe member 9' via a rigid mounting member 35 which supports the power unit 33 in driving engagement with worm 37.Accordingly, activation of power unit 33 in a selected manner causes a corresponding rotation of screw in a predetermined rotational direction, thereby causing a corresponding pivoting of joint element 27 and burner unit 11. Power unit 29 may also serve to support the burner units in an operational position by locking burner units thereat.

It will be appreciated that drive unit 29 may be replaced with manual means for pivoting the joint 27 and burner unit 11, such as a spring or weights. These could alternatively be provided in addition to power unit 29 to serve as reserve or emergency means for raising and lowering the burner units.

It is seen that support arms 39 and/or a support ring 41 may be provided on the burner head 15 for holding cooking utensils in a predetermined position above burner head 15. One of the arms 39 may have incorporated therein electronic ignition means 43 which may be constructed so as to ignite automatically when the burner unit 11 moves into an operating position.

Figure 3:
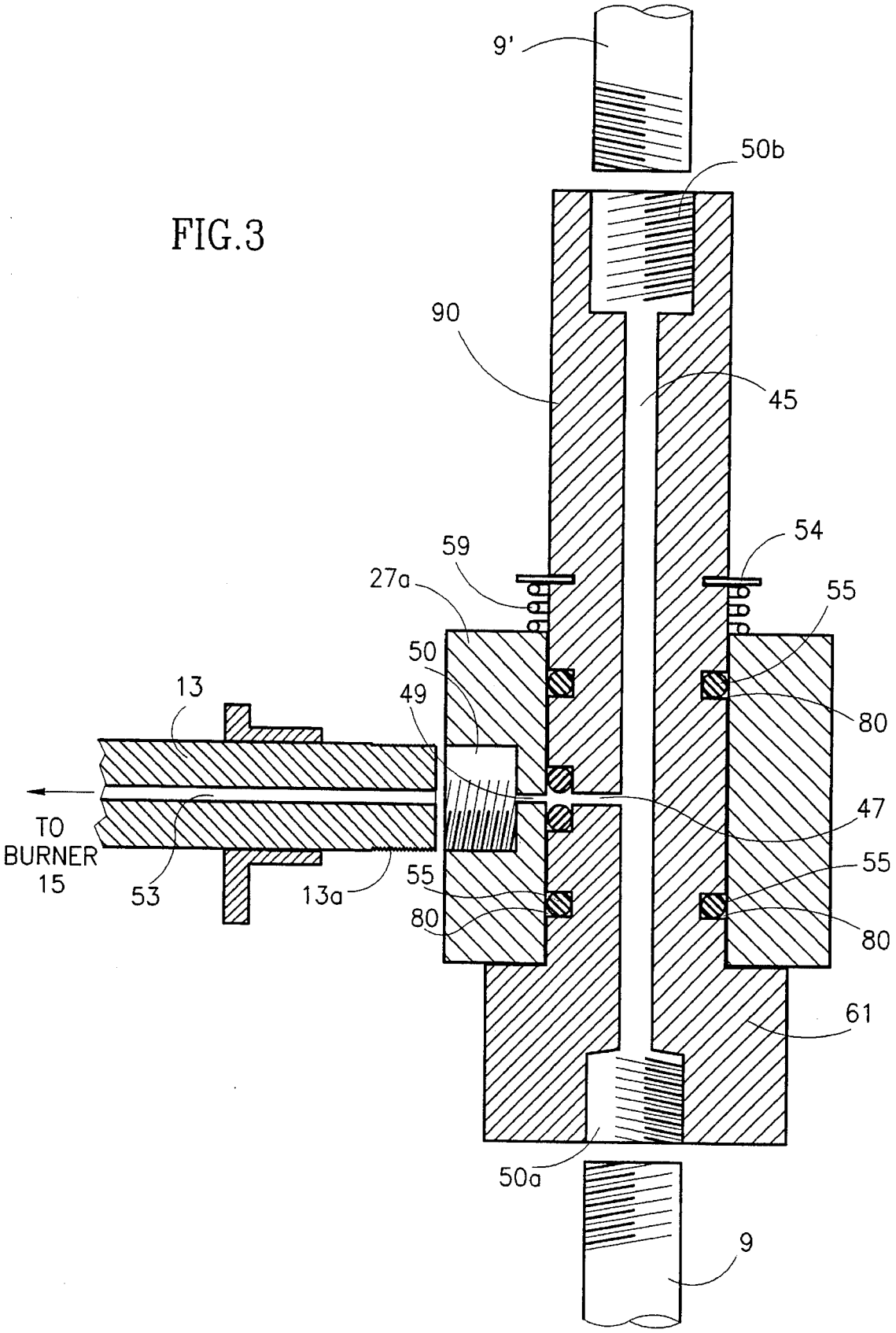
FIG. 3 is a detailed cross-sectional view of a joint element constructed in accordance with an embodiment of the invention.

Referring now to FIG. 3, there is shown a cross-section of the joint element 27 of FIGS. 1 and 2. The joint element is comprised of two main parts, a pipe 90 with a longitudinal bore 45 and a cylindrical collar 27*a* rotatably fitting around said pipe 90. At the ends of bore 45 are apertures 50*a* and 50*b* for connecting to pipe members 9'. Aperture 50*b* may also be closed via a suitable closure element (not shown) so as to prevent exit therefrom of cooking fuel. A bore 47 extends radially from pipe 90 so as to communicate with a radial bore 49 provided in the collar 27*a*.

Bore 49 opens into a further, typically much larger, threaded bore 50 adapted to receive a correspondingly threaded end portion 13*a* of arm 13. Arm 13 has a longitudinal bore 53 formed therein which extends between bore 49 and burner 15, and which thus completes the internal fuel supply line which comprises bores 45, 47, 49 and 53 and which conducts cooking fuel from external fuel supply line 7 (FIG. 1) to the burner head 15.

From the above description of FIG. 3, it will be appreciated that the supply of fuel to the burner head 15 is possible only when bore 53 of the burner arm 13 and bore 49 of collar 27*a* are aligned with bore 47 of pipe 90. In all other positions, whereat collar 27*a* and thus burner arm 13 are rotated relative to pipe 90, fuel flow is blocked due to the non-alignment of bores 47 and 49.

Preferably, a plurality of rubber gaskets 55, such as O-rings, are provided at the interface between an inward-facing surface of collar 27*a* and an outward-facing surface of pipe 90 so as to prevent fuel leaks thereat. Each gasket 55 is preferably mounted in a suitably provided recess 80 in pipe 90.

Collar 27*a* is tightly secured around pipe 90 and prevented from sliding along it by a resilient member 59, such as a rotational spring. Member 59 is arranged about pipe 90 and against a stop member 54 so as to press collar 27*a* against a shoulder 61 formed by a widened portion of pipe 90 remote from stop member 54.

Figure 4:
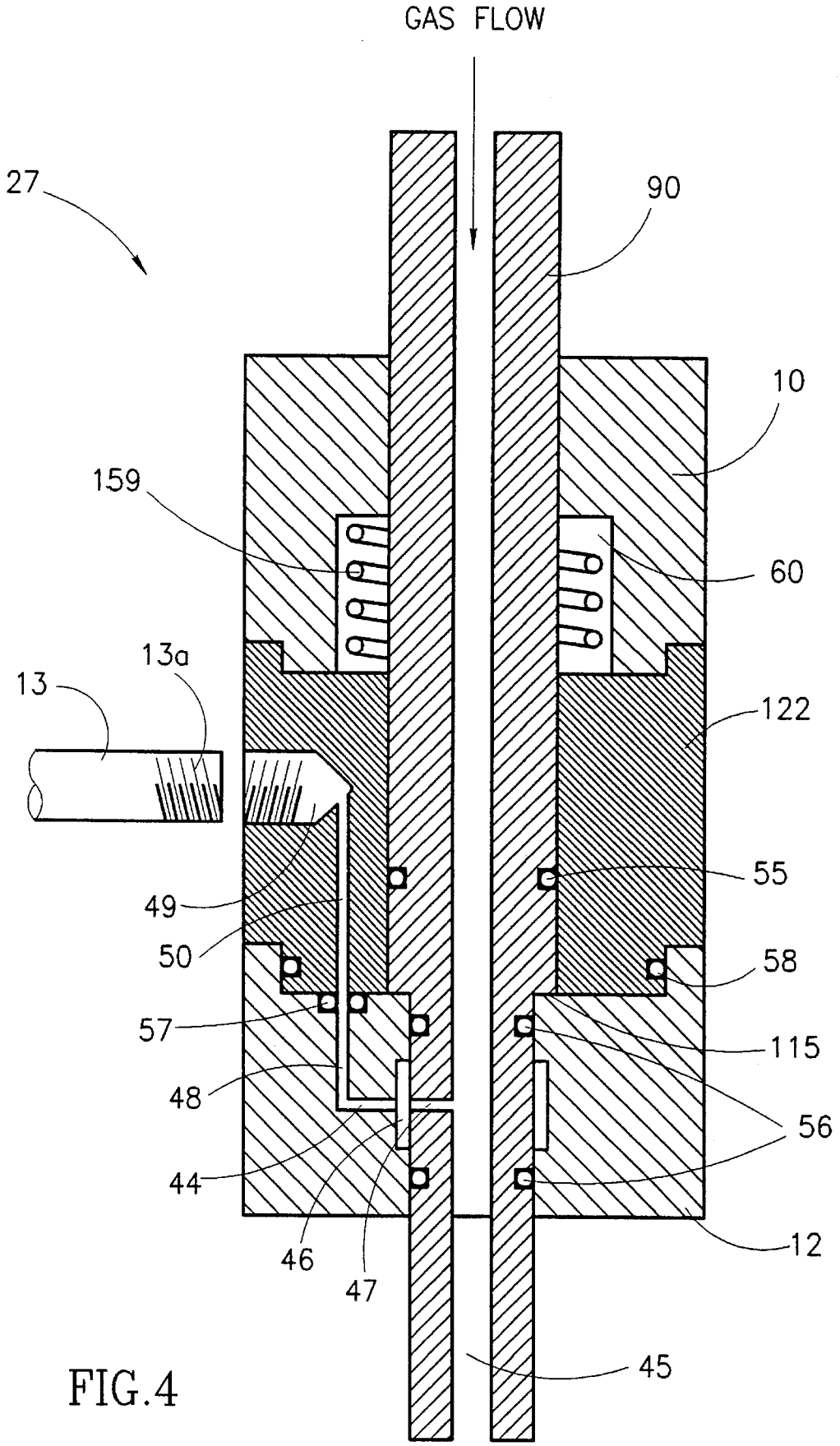
FIG. 4 illustrates in cross-section an alternate embodiment of a preferred joint element.

Referring now to FIG. 4, joint 27 is illustrated in accordance with an alternative embodiment of the invention. According to the illustrated embodiment, it is seen that joint 27 comprises three cylindrical collar elements 10, 12, 122 which fit tightly around pipe 90. Of collar elements 10, 12 and 122, elements 10 and 12 are end elements and element 122 is an intermediate element, disposed between end elements 10 and 12.

End elements 10 and 12 are mounted fixedly to pipe 90 and intermediate element 122 is kept in tight contact with element 12 by means of a resilient member 159, such as a spring. Resilient member 159 surrounds pipe 90 and is retained in a recess 60 so as to press intermediate element 122 against end element 12. Pipe 90 has a smaller outer diameter in the section surrounded by end element 12 so as to define a shoulder 115, thus determining the location of end element 12.

Pipe 90 has formed therein a longitudinal bore 45 from which extends a transverse bore 47 which communicates with a groove 45 formed on an inward-facing surface of cylinder 12. End element 12 further defines a radial first bore 44 which leads into a longitudinal second bore 48 formed generally at right angles thereto. The groove 46 is provided so as to enable transverse bore 47 to have a variety of angles with respect to longitudinal bore 45 and still enable fuel flow from bore 45 through groove 46.

Intermediate element 122 is mounted for selectable rotation about pipe 90 and has formed therein a longitudinal bore 50 which, when collar 122 is properly aligned with end element 12, communicates with bore 48. Bore 50 terminates in a perpendicular threaded opening 49 for connection to threaded portion 13*a* of arm 13.

Since intermediate element 122 is rotatable around pipe 90, it is evident from the structure described above that fuel supply to the burner head 15 (FIGS. 1 and 2) is possible only when the arm 13 is in a predetermined, typically horizontal position such that bore 50 is aligned with bore 48. In this position fuel is conducted from bore 45 through bore 47 into groove 46, and further into bores 44 and 50 and into threaded opening 49.

When the burner arm 13 is in a position other than the predetermined position, the inlet of bore 50 is not aligned with bore 48, and fuel supply therealong is thus prevented. To ensure prevention of gas leaks, O-ring seals 56 are placed on both sides of groove 46 within matching recesses at the contact zone between pipe 90 and end element 12.

It is seen that gaskets 57, 55 and 58 are provided for sealing the interface between bore 48 and intermediate element 122, for sealing the interface between intermediate element 122 and pipe 90, and for sealing the interface between elements 12 and 122, respectively. Typically, gaskets 57, 55 and 58 are O-rings.

Figure 5:
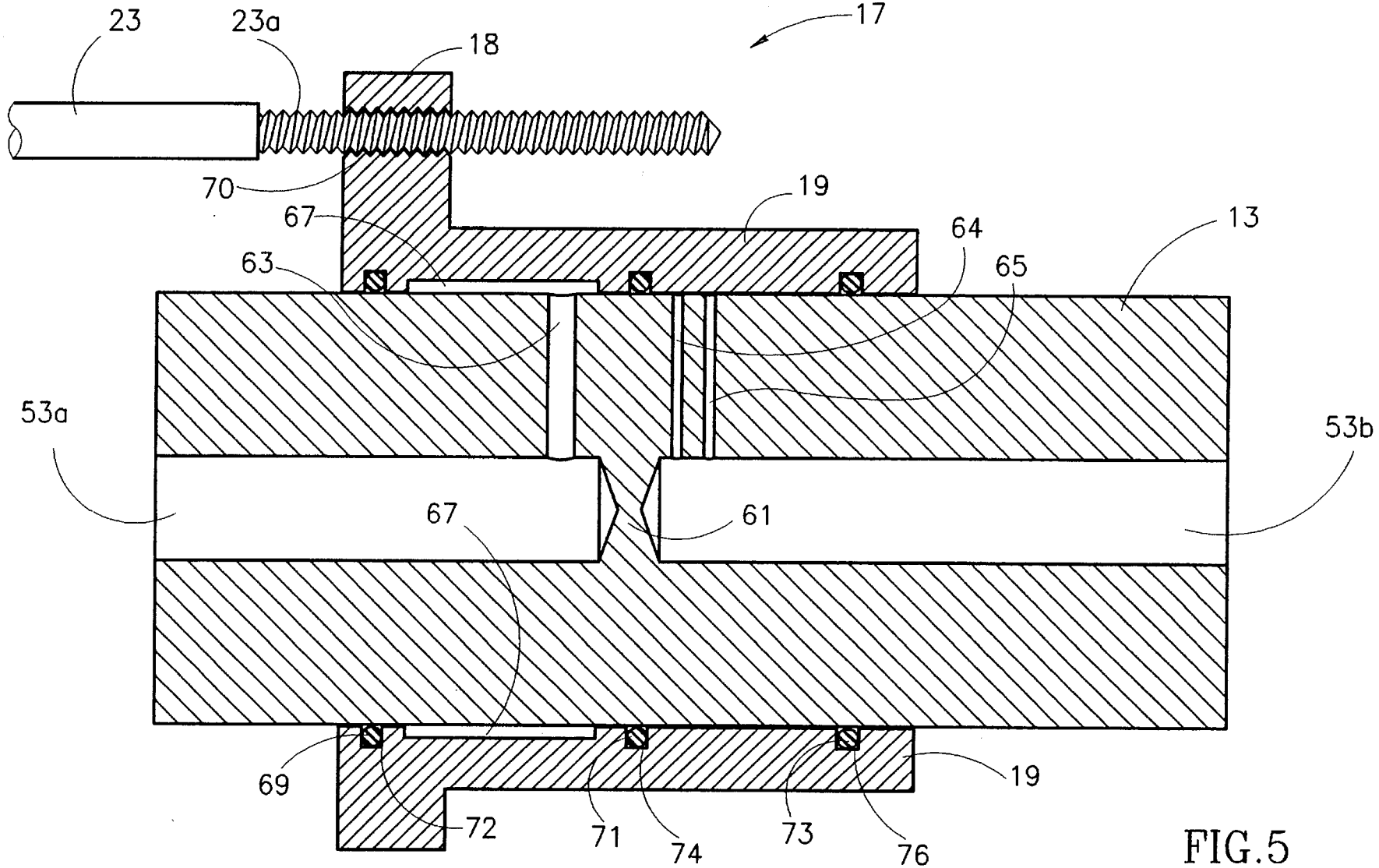
FIG. 5 illustrates one embodiment of a fluid fuel regulator.

Reference is now made to FIG. 5, in which is shown fuel flow regulator 17 constructed in accordance with an embodiment of the invention. The illustrated structure may be most suitable for use with gas, but is may also be adapted for use with other fluid fuels.

In accordance with the illustrated embodiment, it is seen that regulator 17 comprises a cylindrical collar element 19 mounted about a portion of arm 13. The collar 19 has formed therewith a flange 18 in which is formed a threaded opening 70. A circumferential groove 67 is formed on an inward-facing surface of the collar element 19. There is also provided a screw spindle 23 which has a threaded portion 23a extending through threaded opening 70, and which further has a non-threaded portion 23*b*, which is held in place rotatably via a rigid spindle support 25 (shown in FIGS. 1 and 2) mounted onto arm 13. Accordingly, rotation of spindle 23 causes a linear movement of collar element 19 along arm 13.

In accordance with the present embodiment, arm 13 has formed therein first and second axial bores 53*a* and 53*b* which are separated by a discontinuity 61 in the vicinity of the collar element 19, preventing flow of fuel therethrough. A plurality of transverse, preferably radial, first, second and third bores, respectively referenced 63, 64, 65, serve to connect bores 53*a* and 53*b* with the exterior of arm 13. According to the illustrated arrangement, first transverse bore 63 connects between first bore 53*a* and the exterior of arm 73, and second and third transverse bores 64 and 65 connect between second bore 53*b* and the exterior of arms 13. It is seen that when collar element 19 is arranged along arm 13 such that groove 67 is aligned with first transverse bore 63 and at least second transverse bore 64, fuel flow is permitted between axial bores 53*a* and 53*b*, circumventing discontinuity 61.

Preferably, gaskets 69, 71 and 73 are provided in respective recesses 72, 74 and 76 so as to prevent fuel leakage along the interface between arms 13 and collar element 19.

The regulator 17 works as follows. When collar element 19 is positioned such that groove 67 overlaps transverse bores 63, 64 and 65, fuel supplied from inlet of axial bore 53*b* is conducted through transverse bores 64 and 65, through groove 67 and into transverse bore 63 so as to pass along axial bore 53*a* towards the burner head 15. When the collar 19 is moved longitudinally along arm by turning the spindle 23 via a handle or knob 27 (FIG. 7), the groove 67 is also displaced. If the movement is toward the burner head 15, transverse bore 65 is covered partially or wholly by an inward-facing inner surface of collar element 19, and the flow of fuel is reduced, resulting in the lowering of the flame in the head 15. Further movement in the same direction results in partial covering of bore 64, thus further lowering the flame. If both bores 64, 65 are covered, the flow of fuel is completely blocked.

Figure 6:
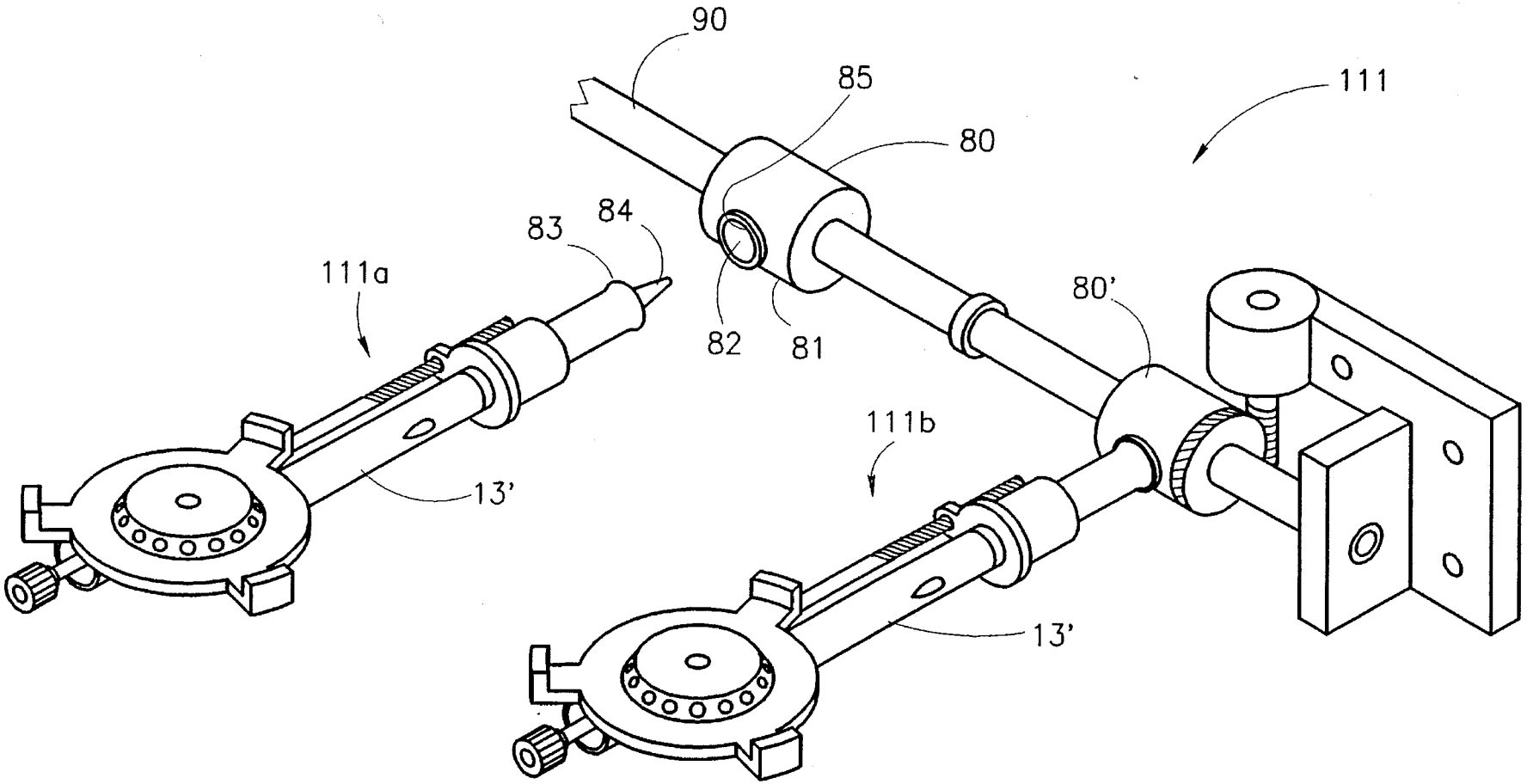
FIG. 6 is an illustration of a joint element constructed in accordance with an alternative embodiment of the invention.

Referring now to FIG. 6, there is shown a stove, referenced generally 111, constructed in accordance with an alternative embodiment of the present invention. Stove 111 is generally similar to stove 1 (FIG. 1) and is therefore, not described herein again in detail except as may be necessary for understanding of the present embodiment. Additionally, components of stove 1 having counterpart components in stove 111 of the present embodiment are denoted by corresponding reference numerals and are not specifically described herein again in detail.

Stove 111 comprises a base which is constituted typically by pipe 90 to which joint elements 80 are attached. Joint elements 80 are formed with female snap-fit receptacles 81 which are sealed when not engaged. Typically, the sealing of receptacles 87 is provided by a spring-mounted spherical sealing member 82 mounted centrally in an opening 85 of receptacle 81.

Stove 111 comprises a plurality of burner units of which two are illustrated. The illustrated burner units are respectively referenced 11*a* and 11*b*, each having, inter alia, a burner arm 13'.

When a burner arm 13' with a predetermined male fitting 83 is inserted into the opening 85 of joint 80, a male protrusions 84 pushes ball 82 inwards, thereby firmly connecting burner arm 133 to pipe 90 and also opening the joint opening 85, thereby permitting passage of fuel from pipe 90 into hollow burner arm 13'.

Further possible features within the scope of the invention include burners with multiple or different type heaters, fuels, controls or timers.

Figure 7:
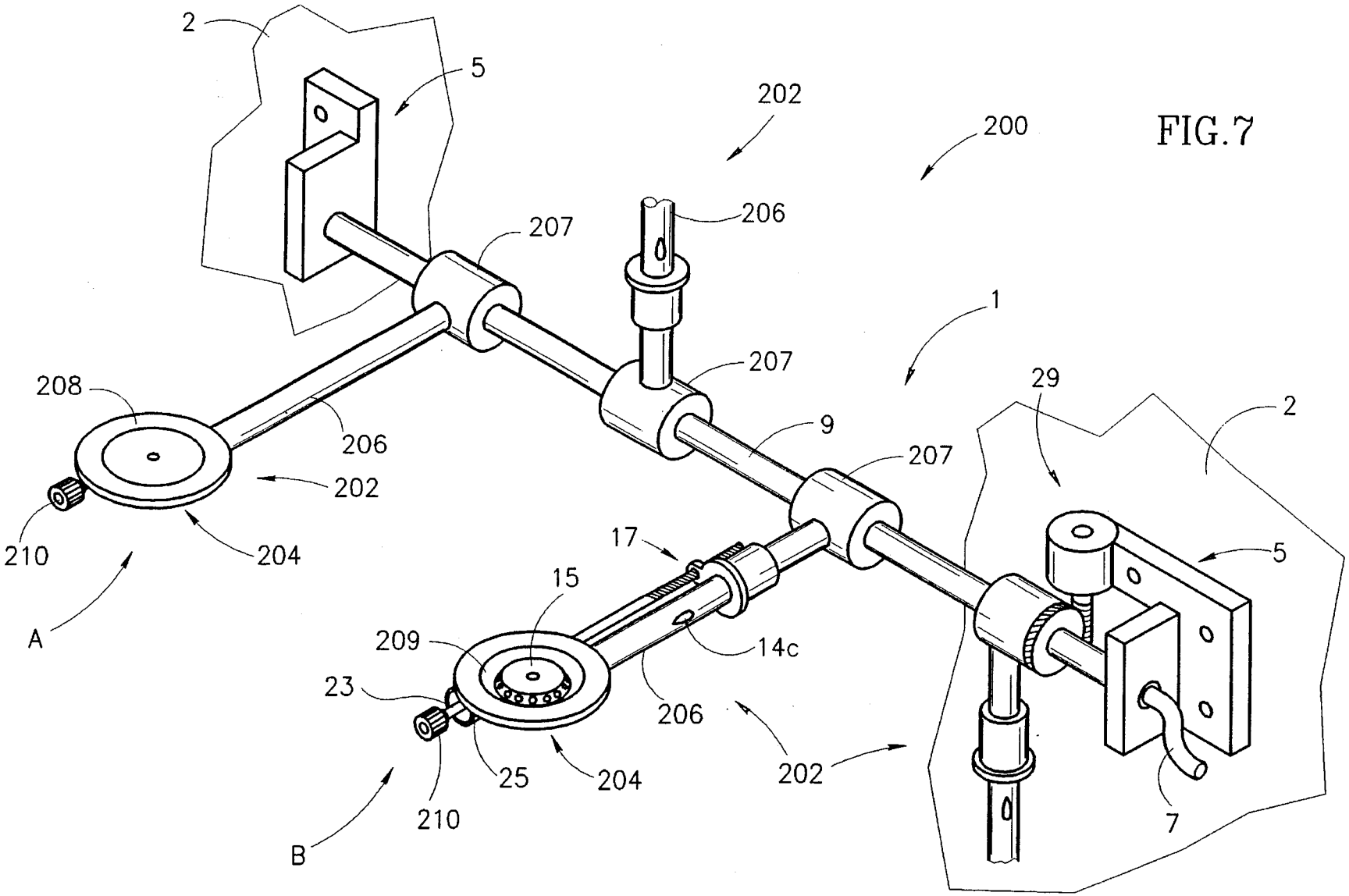
FIG. 7 is a general view of a stove constructed in accordance with yet a Further embodiment of the present invention.

Reference is now made to FIG. 7, in which is shown a stove, referenced generally 200, constructed and operative in accordance with a further embodiment of the invention. Components shown and described above in conjunction with stove 1 hereinabove bear similar reference numerals to those employed in conjunction with stove 1 and are not specifically described again herein.

Stove 200 comprises a plurality of burner units, referenced 202. Each burner unit has a burner head 204 that is mounted, via a burner arm 206 and via a joint 207, onto base 9. Of the plurality of burner heads employed in the present embodiment, one or more may be a fluid fuel burner, such in stove 1, one or more may be an electric burner, such as indicated at A, and one or more may be a combined fluid fuel and electric burner, such as indicated at B.

Both electric burner A and the electric burner portion of burner B comprise an electric burner element 208 which is configured in generally disk-like fashion so as to support thereon a cooking utensil. Burner B also includes a burner head 15, substantially as described hereinabove in conjunction with FIG. 1, which is located in a central opening 209 of electrical element 208. A control knob 210 may be provided for regulating the cooking temperature via a suitable control unit, such as described in conjunction with FIG. 8, and, where appropriate, a system of electrical contacts may be built into joint 207 such that an electrical circuit is completed only when the burner unit is in a predetermined cooking orientation. The system of electrical contacts may be as described hereinbelow in conjunction with FIG. 8.

Figure 8:
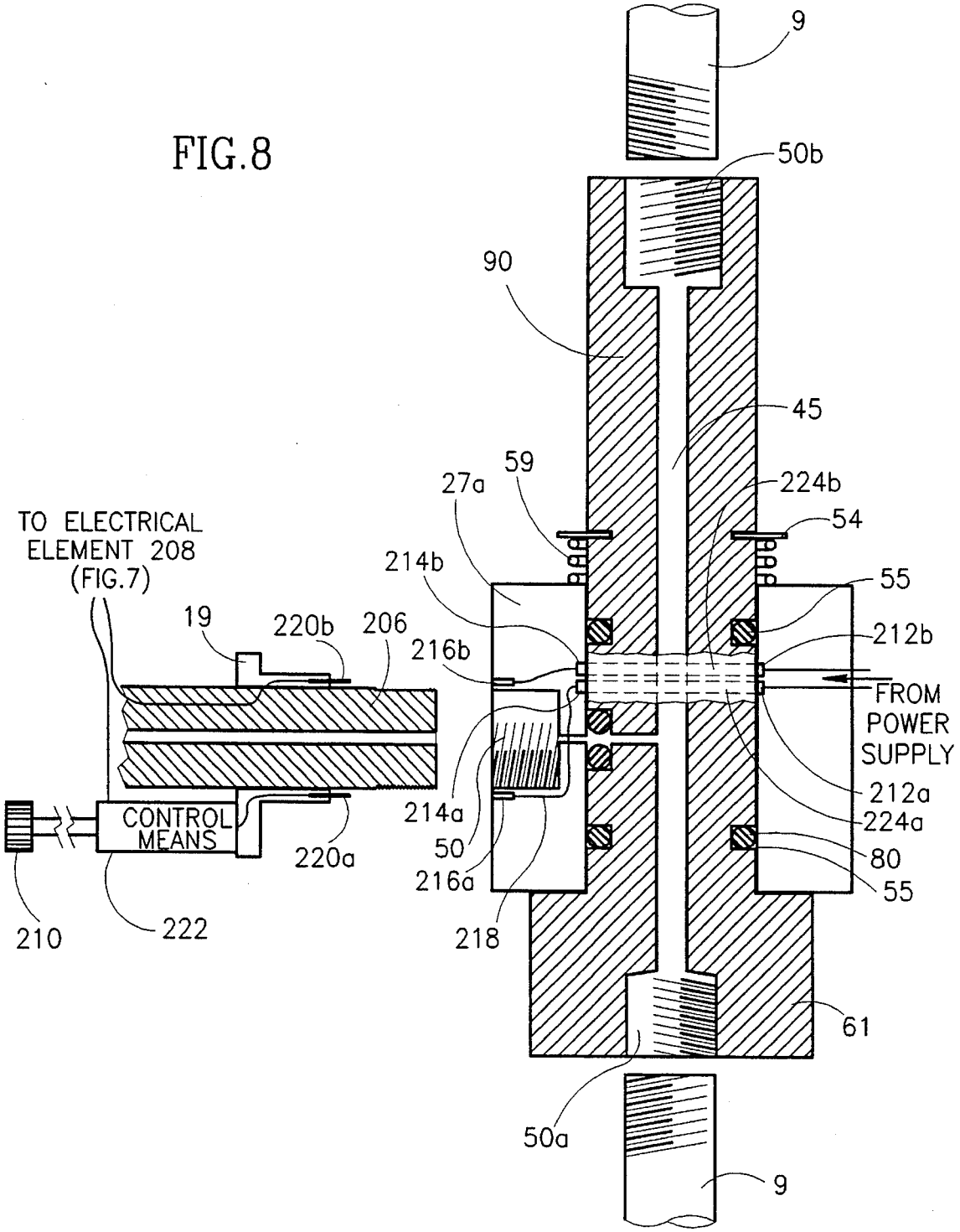
FIG. 8 is a detailed cross-sectional view of a joint element constructed in accordance with the embodiment of FIG. 7.

Referring now also to FIG. 8, it is seen that the joint 207 is constructed so as to permit passage therethrough to combined burner B (FIG. 7) of both fluid fuel and electricity, when the burner unit is in a predetermined cooking orientation only. Joint 207 has a construction that is generally similar to joint 27 and components of joint 207 are therefore designated by reference numerals corresponding to those in FIG. 3.

It will be appreciated, however, that joint 207, in addition to enabling a supply of liquid fuel therethrough, is also adapted to enable a supply of electricity therethrough, as outlined above.

Accordingly, in the illustrated embodiment, it is seen that collar 27*a* has mounted onto an inward-facing surface thereof first and second pairs of electrical contacts, referenced 212*a* and 212*b*, and 214*a* and 214*b*. First pair of contacts 212*a* and 212*b* are associated with an electrical power supply (not shown), typically a mains supply, and second pair of contacts 214*a* and 214*b* form part of a circuit via which electrical power is provided to electrical element 208 of combined burner head B. The circuit further includes a pair of typically female connectors 216*a* and 216*b* arranged on an outward-facing surface of collar 27*a* and connected to the second pair of contacts 214*a* and 214*b* via suitable electrical wiring 218, and a pair of male connectors 220*a* and 220*b* mounted onto collar element 19. Male connectors 220*a* and 220*b* are arranged to plug into female connectors 216*a* and 216*b* when burner arm 206 is engaged with joint 207, in the position illustrated in FIG. 7. Electrical control means, referenced 222, of any suitable type, is also provided so as to enable control of the temperature of element 208 (FIG. 7).

A pair of generally semi-circular electrical contact rings, referenced 224*a* and 224*b* is mounted onto the exterior of pipe 90 such that when collar 27*a* is in a predetermined rotational position relative to the pipe 90, corresponding to a predetermined operative orientation of burner unit B, contact ring 224*a* completes an electrical circuit between contacts 212*a* and 214*a*, and contact ring 224*b* completes an electrical circuit between contacts 212*b* and 214*b*.

It will thus be appreciated that use of burner unit B, whether it is sought to use it for electrical or fluid fuel cooking, is possible only when the burner unit is in its predetermined cooking orientation, and that in all other positions, neither supply of fluid fuel, or of electrical power, is permitted.

It should be noted that all the various electrical contacts and connectors are suitable insulated, although this is not shown for purposes of clarity. It should also be noted that the above-described electrical connections are intended by way of example only, and that any alternative electrical circuit configuration for achieving the same purpose could be used in alternative embodiments of the invention.

It will further be appreciated by persons skilled in the art, that the scope of the present invention is not limited to what has been specifically shown and described hereinabove. The scope of the invention is limited, rather, solely by the claims which follow.

I claim:

1. In a domestic cooking stove, a gas burner assembly comprising:

a rigid gas conduit base pipe member for mounting onto a fixed object, said base pipe member having a longitudinal bore formed therein with one end connecting to a gas supply line and a transverse bore extending between said longitudinal bore and an exterior surface of said base pipe;

a collar member mounted on said base pipe member for axial pivoting thereabout;

at least one gas burner unit mounted on said collar member;

said collar member having a transverse bore with first and second ends, said first end adapted to communicate with said gas burner and said second end adapted for alignment with said transverse bore of said base pipe member when the burner unit is disposed horizontally and for unalignment when said gas burner unit is disposed vertically; and a regulator associated with the gas burner unit for controlling the flow of gas to the burner unit from the gas conduit base pipe.

2. In a domestic cooking stove, a gas burner assembly according to claim 1, wherein said collar member is adapted to permit pivoting of said burner unit between an operative orientation, whereat cooking on said burner unit is permitted, and a storage position.

3. In a domestic cooking stove, a gas burner assembly according to claim 2, wherein said regulator is operative to permit gas supply through said base pipe member to said burner unit when said burner unit is in said operative orientation, and is further operative to prevent gas supply to said burner unit when said burner unit is not in said operative condition.

4. In a domestic cooking stove, a gas burner assembly according to claim 1, wherein said at least one gas burner unit comprises:

a gas burner head; and a generally rigid gas burner arm adapted to support said gas burner head and further adapted for connection to said collar member and including means for conducting gas along said gas burner arm to said gas burner head.

5. In a domestic cooking stove, a gas burner assembly according to claim 3, further comprising additional gas regulating means for regulating a gas supply along said gas burner arm when said gas burner unit is in said operative orientation.

6. In a domestic cooking stove, a gas burner assembly according to claim 1, wherein said collar member comprises three serially juxtaposed collar elements arranged along said pipe member, wherein said second collar element is mounted for selectable rotation about said pipe member, said first collar element having a throughgoing bore whose one end forms a continuum with said transverse bore of said pipe member and whose other end exits at an interface between said first and second collar elements, said second collar element having a throughgoing bore whose first end is adapted to be aligned with the other end of said bore of said first collar element and whose second end is adapted to be connected to said burner unit.

7. In a domestic cooking stove, a gas burner assembly according to claim 6, further including, at said interface between said bore of said first collar element and said transverse bore of said pipe, groove means for permitting fuel flow therealong.

8. In a domestic cooking stove, a gas burner assembly according to claim 1, wherein said burner unit is adapted for releasable attachment to said collar member via snap-fit coupling means.

9. In a domestic cooking stove, a gas burner assembly according to claim 1, comprising at least two gas burner assemblies mounted in series.

10. In a domestic cooking stove, a gas burner assembly according to claim 1, further comprising motor means for moving said burner unit about said base pipe between a horizontal operative orientation and a vertical storage position.

* * * * *